US005946872A

United States Patent [19]

Pardo

[11] Patent Number: 5,946,872

[45] Date of Patent: Sep. 7, 1999

[54] METHOD AND APPARATUS FOR CONSTRUCTING SUSPENDED CONCRETE FLOORS AND ROOFS

[76] Inventor: Jorge Pardo, P.O. Box 3335, Reston, Va. 22090

[21] Appl. No.: 09/012,033

[22] Filed: Jan. 22, 1998

[51] Int. Cl.[6] ..... E04C 1/00

[52] U.S. Cl. ..... 52/437; 52/434; 52/415; 52/604

[58] Field of Search ..... 52/320, 322, 340, 52/321, 323, 324, 596, 597, 483.1, 489.1, 250, 724.1, 724.4, 726.2, 712, 601, 603, 604, 605, 415, 432, 434, 435, 437, 438; 24/546, 67.9, 552, 555, 336

[56] References Cited

U.S. PATENT DOCUMENTS

| | | | |
|---|---|---|---|
| Re. 22,569 | 11/1944 | Abeles . | |
| D. 210,876 | 4/1968 | Kocher et al. . | |
| 922,594 | 5/1909 | Keagle . | |
| 1,095,204 | 5/1914 | Golding . | |
| 1,306,962 | 6/1919 | Jagdmann . | |
| 1,990,001 | 2/1935 | Rutten | 52/724.1 |
| 2,101,538 | 12/1937 | Faber . | |
| 2,328,453 | 8/1943 | Hopewell . | |
| 3,201,907 | 8/1965 | Henderson | 52/724.1 |
| 3,319,387 | 5/1967 | Stewing et al. . | |
| 3,707,819 | 1/1973 | Calhoun et al. . | |
| 3,948,008 | 4/1976 | Goetz . | |
| 4,694,629 | 9/1987 | Azimi . | |
| 4,903,450 | 2/1990 | Adams | 52/724.1 |
| 4,989,382 | 2/1991 | Spronken . | |
| 5,428,930 | 7/1995 | Bagley et al. | 52/489.1 |

FOREIGN PATENT DOCUMENTS

| | | | |
|---|---|---|---|
| 55090 | 8/1938 | Denmark | 52/324 |
| 354599 | 11/1937 | Italy | 352/434 |
| 10385 | of 1915 | United Kingdom | 52/712 |
| 2042616 | 9/1980 | United Kingdom | 52/324 |

OTHER PUBLICATIONS

Supplement No. 1 to Design Data on Concrete Joist–Concrete Filler Block Floors, National Concrete Masonry Association, 1948.

Concrete Block Joist Floors for Residential and Other Light–Occupancy Buildings, Portland Cement Association, 1949.

Roof and Floor Slabs Manufactured by Basalt Rock Co., Inc., 1949.

Omnia Concrete Floors and Roofs, Omnia Incorporated, 1960.

Joistile Floors and Roofs, Masolite Division—General Dredging Co., Inc. 1960.

DoxPlank Floor and Roof System.

Concrete Tee Blok, Cinder Block & Material Co.

*Primary Examiner*—Carl D. Friedman
*Assistant Examiner*—Dennis L. Dorsey
*Attorney, Agent, or Firm*—Lane, Aitken & McCann

[57] ABSTRACT

A horizontal diaphragm for the generation of floor and roof structures includes a plurality of construction units arranged in rows and integrated joists by clip ties, wherein a load transferring material fills spaces between adjacent construction units in a row, both transversely and longitudinally. Each construction unit includes a lip projecting toward an adjacent unit in the row and defining with the other construction unit a space for receiving the filler material. The clip ties are anchored in the joists and are movable from a position obstructing the placement of additional construction units on the joists to a position integrating the previous construction unit with the joists. The joists comprise U-shaped troughs filled with grout in which the clip ties are anchored at spaced locations. The structure defining the trough can be monolithic or can comprise a plurality of discrete units placed in alignment and connected by reinforcing bars. The joists themselves can be monolithic, integrating the troughs and the grout around the reinforcement.

37 Claims, 7 Drawing Sheets

METHOD AND APPARATUS FOR CONSTRUCTING SUSPENDED CONCRETE FLOORS AND ROOFS

BACKGROUND OF THE INVENTION

The present invention relates to suspended concrete diaphragms for the construction of floors and roofs and, more particularly, to floors made out of discrete concrete units each of which units is sufficiently light in weight to be installed without the aid of cranes and, therefore, the diaphragms are suitable for residential and light commercial construction.

There are known systems of floors composed of precast concrete units. One drawback of such floors is that the units are so heavy that cranes are needed to move and handle each of the elongate units. In addition, there are known systems involving forms and poured concrete for forming a floor in-situ. However, poured concrete is usually too heavy for most residential construction, and too expensive due to the forming and shoring work that is needed.

In contrast to precast and poured concrete, there are known systems for constructing floors assembled out of concrete blocks where the blocks are placed in abutment with one another between adjacent joists to form a continuous surface. However, in these systems, the blocks do not act structurally as part of the horizontal slab spanning between supports; that is, the blocks only act to support localized loads, including their own weight, strictly corresponding to their area. These blocks merely act as forms, filling the spaces between tension joists and providing a surface onto which concrete can be poured. It is the poured concrete, when it cures, acting in unison with the steel-reinforced joists, which provides the structural strength for the floor. The poured concrete bears the horizontally-acting compressive force resulting from the weight of the floor spanning from one end support to the other, while the joists resist the corresponding tensile loads. As a result, extensive shoring is needed for this type of system to support the blocks and the concrete during installation, and the resulting floor is very heavy and inefficient due to the large amount of dead weight it contains. The installation of such floors is labor-intensive, and expensive, and the extensive shoring obstructs the space below. Furthermore, time is required after work on the floor is done for the concrete to cure before the temporary shoring can be removed and further construction can take place.

There is also a known concrete masonry floor system in which the concrete units are arranged in rows to contain both compressive and tensile resistance elements, and the units in each row are placed in direct contact against one another to transmit the horizontal forces resulting from the floor loads. In such a system, the concrete units are pre-compressed against one another by means of steel bars or cables inserted longitudinally through holes in the concrete units and tensioned during the row pre-assembly process, whereby the reinforcing bars exert compressive forces on the concrete units even before such forces are contributed by the floor spanning loads. A drawback with such a known system is caused by inevitable imperfections in the mating surfaces of the concrete units due to the nature of molding concrete blocks. These imperfections result in surfaces which do not mate perfectly, distanced by projecting points which experience high stress concentrations when the concrete units are placed in compression. Such systems have actually failed explosively due to failures in the units resulting from the stress concentrations. In order to avoid the stress concentrations which have caused this problem, it is necessary to precision-grind the mating faces of the blocks for a precise fit before the blocks are assembled. Accordingly, this system is very expensive to use.

Another type of suspended floor system which has supplanted most of the block systems described above uses a metal deck instead of blocks as a form between steel joists, the metal deck being lightweight, and corrugated so that little or no shoring is required. Concrete is poured onto the metal deck form together with conveniently placed reinforcing bars to resist the tensile loads acting on the slab from its spanning action between the joists. Although the relative light weight and cost of this system has allowed it to be widely used, its drawbacks include extensive labor to pump the concrete up onto the metal deck and to finish the structural slabs. While requiring elaborate protection of its exposed metal underside to prevent its collapse in case of a fire underneath. In some systems employing metal decks, the decks are more than forms; they act structurally with the concrete. such systems employ metal joists, and the decks and joists are subject to melting and collapse in a fire. These systems require elaborate protection of their exposed metal undersides to prevent their collapse in case of a fire underneath.

SUMMARY OF THE INVENTION

By the present invention, a suspended floor system is provided which minimizes labor costs at the construction site, the highest costs in a construction project. Furthermore, the entire system is fireproof, soundproof, and sufficiently light in weight that its components can be moved into place and installed by workers without the help of cranes or hoists. Moreover, it is also sufficiently compact that the components can be brought into place through a small opening, such as a window. As a result, the system is well suited for constructing floors in old buildings of which only the shells remain.

The floor is made out of discrete concrete masonry coffer units (used to resist horizontally longitudinal compression), which are integrated with steel reinforced concrete joists (used to resist horizontally longitudinal tension forces) to act as a composite unit. The coffer (compression) units cooperate with the (tension) joists to resist the horizontal forces which result from the spanning action of the floor as it carries its own weight plus the so-called live loads imposed by occupants and their furnishings. Shoring of this new system is minimized, due to its lighter weight, being that all elements of the system are acting structurally to resist the horizontally acting forces arising from the bridging of the span between supports. Although the coffer units are in compression against one another (beam action), stress concentrations are avoided by the presence of a plastic grout substance in the joints between adjacent units which accommodates the irregularities of fabrication. In order to provide interstices between adjacent coffer units and thereby assure the ingress of the plastic grout substance interstitially between the coffers in order to fill all the spaces around any projections caused by the imprecise nature of molding the units, a lip projects from each of the units as a spacer into engagement with an adjacent unit to form the joint interstices and to provide a surface for containing the plastic grout substance prior to curing. Accordingly, stress concentrations in the coffer units are avoided, as forces are uniformly distributed and transmitted through the grout filler.

The joists are formed with a predetermined amount of camber so that the weight of the coffer units on the joists will tend to cause the joists to straighten into a horizontal line and, simultaneously, place the coffer units into firm contact with one another. The composite action between the compression elements (coffers) and their tensile counterparts (joists) is attained by means of vertically disposed clip ties. Each clip tie has a lower portion anchored in the joists and an upper portion pivotally connected to the lower portion to swing up to a position engaging shoulders on the coffer units, thereby integrating the units with the joists in a homogeneous structural unit. Furthermore, the clip ties reinforce the joists against shear forces which act longitudinally through the joists. The clip ties are spaced along the length of each joist at distances coincidental with the transverse joints of the assembly, that is, approximately equal to the front-to-rear dimension of one of the units, whereby sites for laying the units are defined on the joists between adjacent clip ties. The pivoting feature of the clip ties creates a self-inspecting assembly sequence, in that the mere proper dry placement of each coffer unit on the joists necessitates that the clip tie(s) connecting the previous unit must be in an engaged position integrating the previously laid unit with the joists in order to clear the site for the next coffer unit. The clip-reception shoulders on of the coffers are spaced below the top surfaces of the coffer units, and the clip ties are accommodated entirely below the top surfaces of the units, so that they do not project above the floor surface once the interstices between adjacent units are filled with grout. The coffer units have arched lower surfaces, so that a row of the units defines a channel which can be used to receive mechanical ducts, electrical wiring, or plumbing. The shoulder cavities of the units can also accommodate reinforcing bars below the level of the floor surface. As a result, the upper region of the floor, which is normally in compression, can also bear loads in tension and, therefore, the present invention can be used in cantilever applications.

The joists can be precast to be homogeneous in cross-section with steel reinforcing bars positioned longitudinally. As one alternative, the joists can be made from moldable U-shaped blocks positioned in a row and defining a trough in which reinfocing bars can be positioned and concrete can be poured. As another alternative, the joists can be made from moldable blocks each of which defines the shape of one of the U-shaped blocks bisected at the bottom of the 'U'. This last alternative provides the system of floors according to the present invention with much greater design freedom. More specifically, it allows tapered or flaring joists to be formed. Such joists can be formed by arranging the half 'U' blocks defining one side of the joist along a line diverging at an angle from a line along which the half 'U' blocks of the other side of the joist are arranged. This defines a tapering or flaring trough, which is filled with concrete to define a tapering or flaring joist. This system allows floor sections to lie at angles relative to one another as an alternative to being parallel and, thus, gives the system of the present invention the ability to construct floor sections which can be trapezoids as opposed to simple parallelograms.

DETAILED DESCRIPTION OF THE PREFERRED EMBODIMENT

Figure 1:
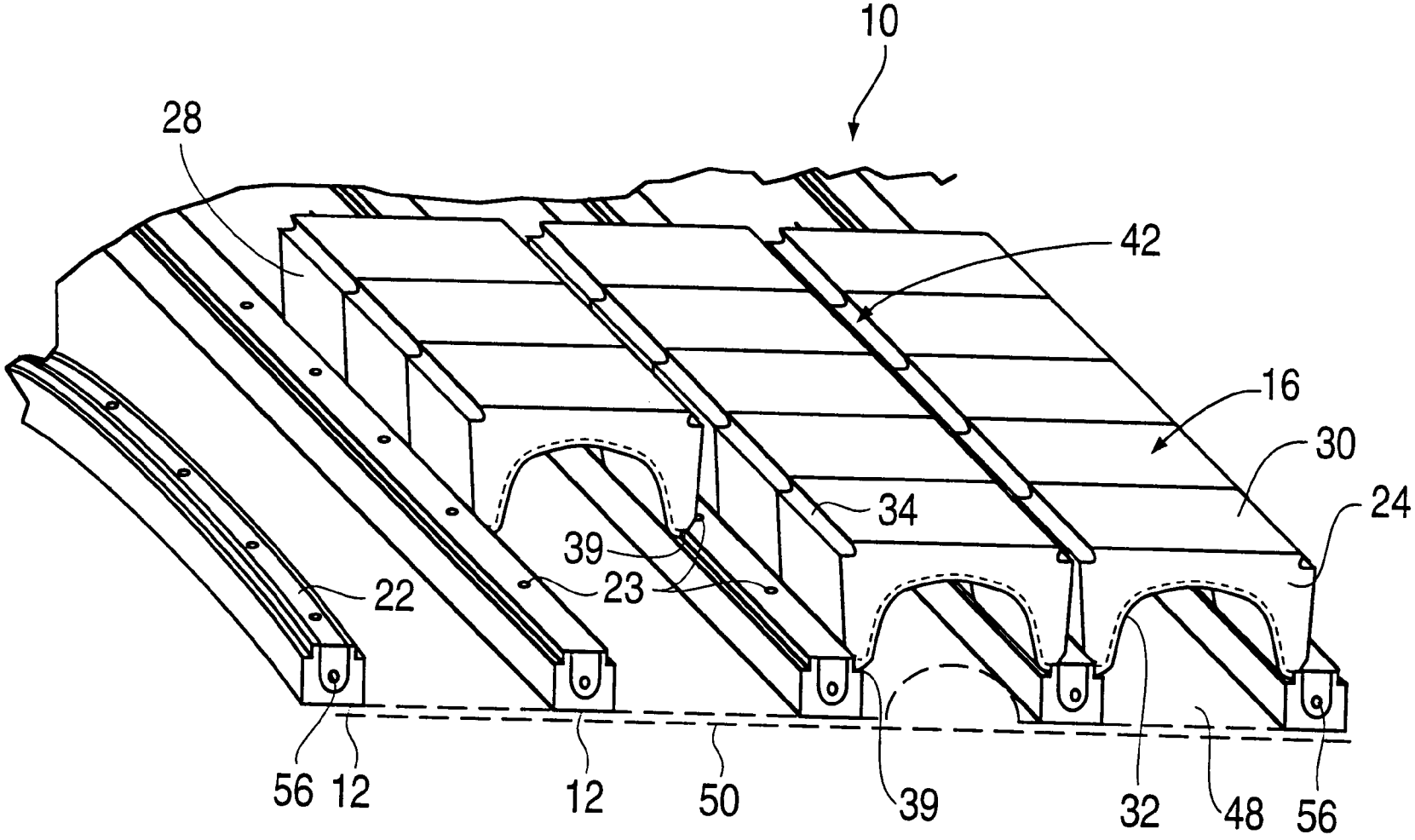
FIG. 1 is a schematic perspective view of a portion of a partially constructed floor according to the present invention.
Figure 2:
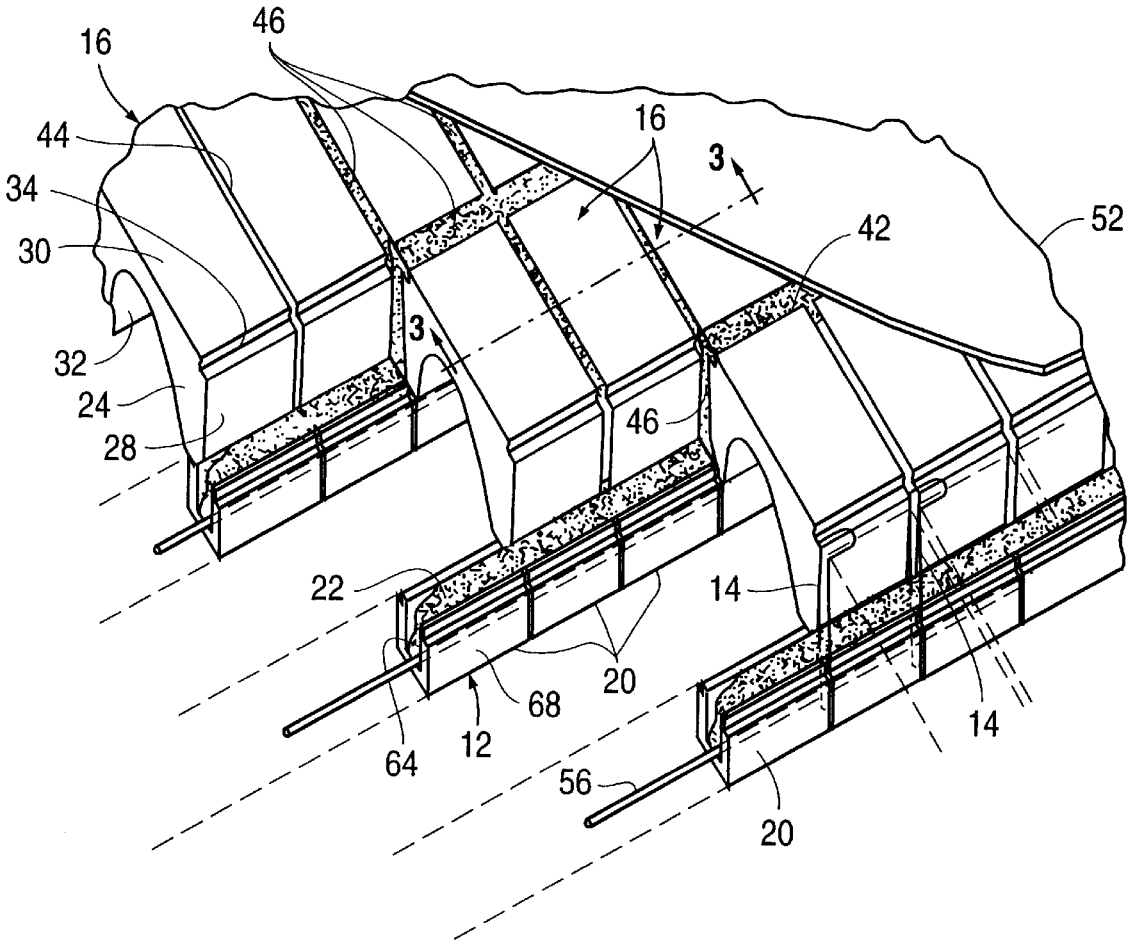
FIG. 2 is a view from a different perspective of a partially constructed floor according to the present invention.

As can be seen from FIGS. 1 and 2, the concrete masonry floors according to the present invention, which are designated generally by the reference numeral 10, include prefabricated joists 12, composite action clip ties 14, and interlocking compression coffer units 16. The joists 12 are cambered from end to end, as can be seen from the leftmost joist 12 of FIG. 1, and they can be monolithic, as shown in FIG. 1, or they can be made from moldable blocks 20, as shown in FIG. 2. The joists 12 define U-shaped troughs to contain tensile reinforcement, such as reinforcing bars, and to receive a filling of a plastic grout fill or bonding substance 22, such as concrete, to protect the reinforcement and to transmit tensile forces to and from the reinforcement. The clip ties 14, which are preferably steel, are inserted at predetermined positions, spaced from one another by a distance substantially equal to the front-to-rear dimension of a coffer unit 16, anchored to the tensile reinforcement, and embedded in the grout fill 22. The clip ties 14 become integral parts of the joists 12 upon the hardening of the grout fill 22, which becomes homogeneously part of the coffer units 16 themselves. The clip ties 14 are not shown in FIG. 1, but their locations are represented by the dots 23.

In combination, the joists 12, the clip ties 14 and the coffer units 16 form the floor 10, a ceiling, or both. The joists 12 are placed parallel to each other, separated from each other by a distance that is just slightly less than equal to the length of the coffer units 16. The coffer units 16 are placed across the space between adjacent joists 12 such that sides of the coffer units rest on the joists. Thus, the coffer units 16 form their own supporting surface as they are laid. The weight of the coffer units 16 on the joists 12 tends to straighten out the camber in the joists, as can be seen in all but the leftmost joist 12 in FIG. 1, and places the coffer units along the joists in mild compression though separated by their integral spacer-lips. Each two coffer units 16 which are positioned laterally with respect to each other, in different rows, are secured to a joist 12 by swinging one of the steel clip ties 14 on the joist up to engage shoulders on the top portions of the coffer units.

As can be seen from FIGS. 1–4, each coffer unit 16 has a vertical front surface 24, a vertical rear surface 26 parallel to the front surface, side surfaces 28 which are generally vertical but are slightly inclined laterally outward from bottom to top, a horizontal flat top surface 30, and a bottom surface 32 which is arched, or coffered, from one of the side surfaces to the other. Horizontal shoulders 34 extending from the front surface 24 to the rear surface 26 are defined at the tops of the side surfaces 28, below the level of the top surface 30.

The top surface 30 is undercut along the shoulders 34 to define longitudinal recesses 35 along the shoulders. The recesses 35 allow concrete to flow around the clip ties engaging the shoulders 34 and key the concrete to the coffer units 16. The side surfaces 28 are inclined inwardly from the shoulders 34 to the bottom of the coffer unit 16, and the angle of inclination is increased near the bottom at surface portion 28'. This inclination increases the size of the space between each coffer unit 16 and a facing coffer unit in an adjacent row. This improves the flow of concrete into the space so that the entire volume defined by the sides 28 of adjacent coffer units 16 and the top of the joists 12 is filled with the concrete.

The side surfaces 28 and the bottom surface 32 taper slightly toward the rest of the coffer unit 16 from the front surface 24 to the rear surface 26. The tapering of the bottom surface 32 causes the cross sectional area of the channel to increase slightly from the front surface 24 to the rear surface 26. The tapering of these surfaces is present to permit the coffer units 16 to slip easily from the mold of a standard concrete block machine, in which the coffer units are formed.

An arcuate lip 36 projects rearward from the rear surface 26 of the coffer unit 16 along the coffer bottom surface 32 such that a bottom surface 38 of the arcuate lip 36 defines a portion of the coffered bottom surface 32 of the coffer unit. The coffer unit 16 defines elongate interlocking channels 39 for receiving edges of the joists 12. The arcuate lip 36 also includes a vertical surface 40 and a bevel surface 41 extending between the vertical surface 40 and the rear surface 26 of the coffer unit.

The interlocking compression coffer units can be manufactured from any common substance that is used to make common structural building blocks, such as concrete.

As can best be seen from FIGS. 1 and 2, when the coffer units 16 are in position on the joists 12, there is an interstitial space 42 between coffer units 16 whose side surfaces 28 face one another, and also an interstitial space 44 between adjacent coffer units 16 whose front and rear surfaces 24, 26 face one another, that is, between adjacent coffer units in the same row. The interstitial space 44 is a result of the arcuate lip 36 projecting rearward from the rear surface 26 and engaging the front surface 24 of the adjacent coffer unit 16 below the level of the top surfaces 30 of the coffer units. These interstitial spaces 42 and 44 are filled with grout 46 made of a cementitious mixture of sand and portland cement.

A cavity 48 formed by the coffered bottom surface 32 of the coffer unit 16 can be used for mechanical ducts, electrical wiring, or plumbing. Furthermore, the bottom of the floor 10 defined by the joists 12 and the coffer units 16 can be finished with a conventional ceiling 50 (FIG. 1), and the top can be finished with conventional flooring material 52 or with roofing membranes, in the case of roof assemblies. FIG. 2). The grouting completes the installation of the structural part of the floor and then carpet, tile or other finish flooring or roofing is applied directly to the flush surface defined by the tops of the coffer units 16 and the grout. Temporary shoring at about 6 ft. intervals (on center) may only be removed from underneath joists, after the grout fill in the joint interstices has cured sufficiently to transmit compressive forces between the units.

The arch-shape of the coffer units 16 makes the coffer units stable as soon as they are placed on the joists 12. The clip ties 14 are spaced along the joists by a distance equal to the thickness of the coffer units 16. As each coffer unit 16 is put into position, the clip ties 14 adjacent to it are pivoted upward and into engagement with the shoulders 34 on the coffer unit. When all of the coffer units 16 have been laid, the concrete grout 46 is placed in all of the spaces between the coffer units. The grout 46 is made flush with the tops of the coffer units 16, and after the grout cures, the resulting structure is ready for carpeting, tile or other types of flooring or roofing materials. Unlike previous systems, there is no need to pour concrete over the top of the structure as in the previous systems, since the coffer units 16 bear the compressive forces in the floor and, through their ties to the joists 12, coact with the joists, which bear the tension loads.

The joists 12 are typically spaced at 16 to 20 inches on center. An optional finished ceiling can be secured to the bottom surfaces of the joists 12.

Figure 3:
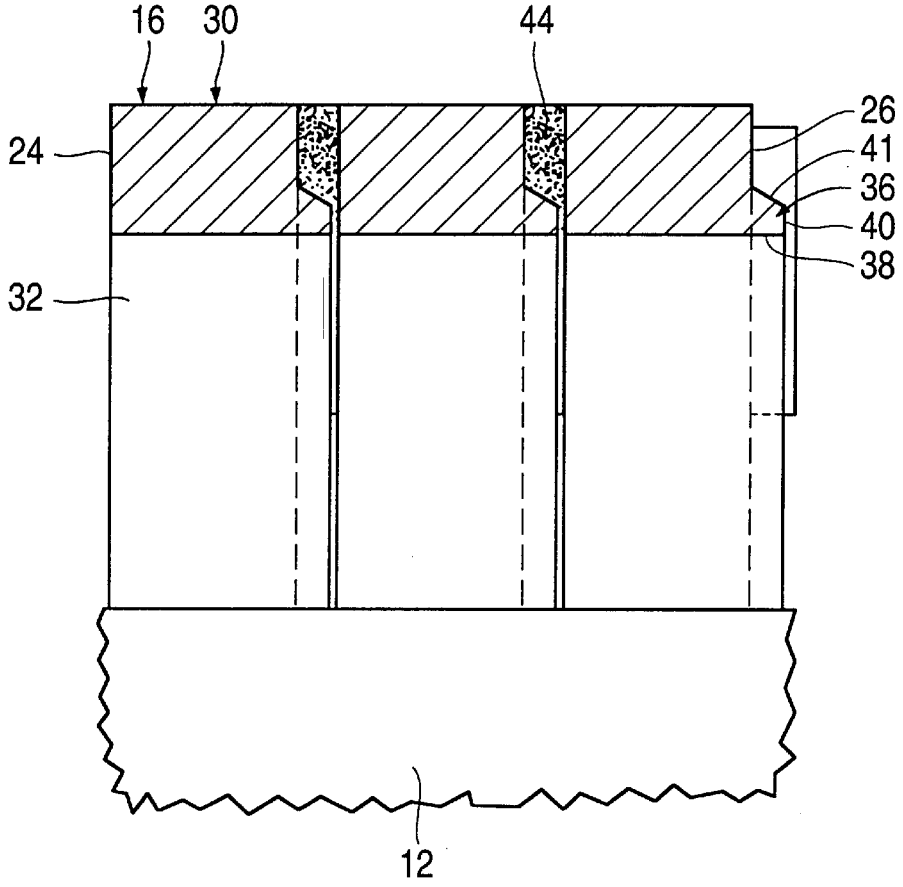
FIG. 3 is a cross-section through a plurality of interlocking compression coffer units in a row taken along the line 3—3 in FIG. 2.
Figure 4:
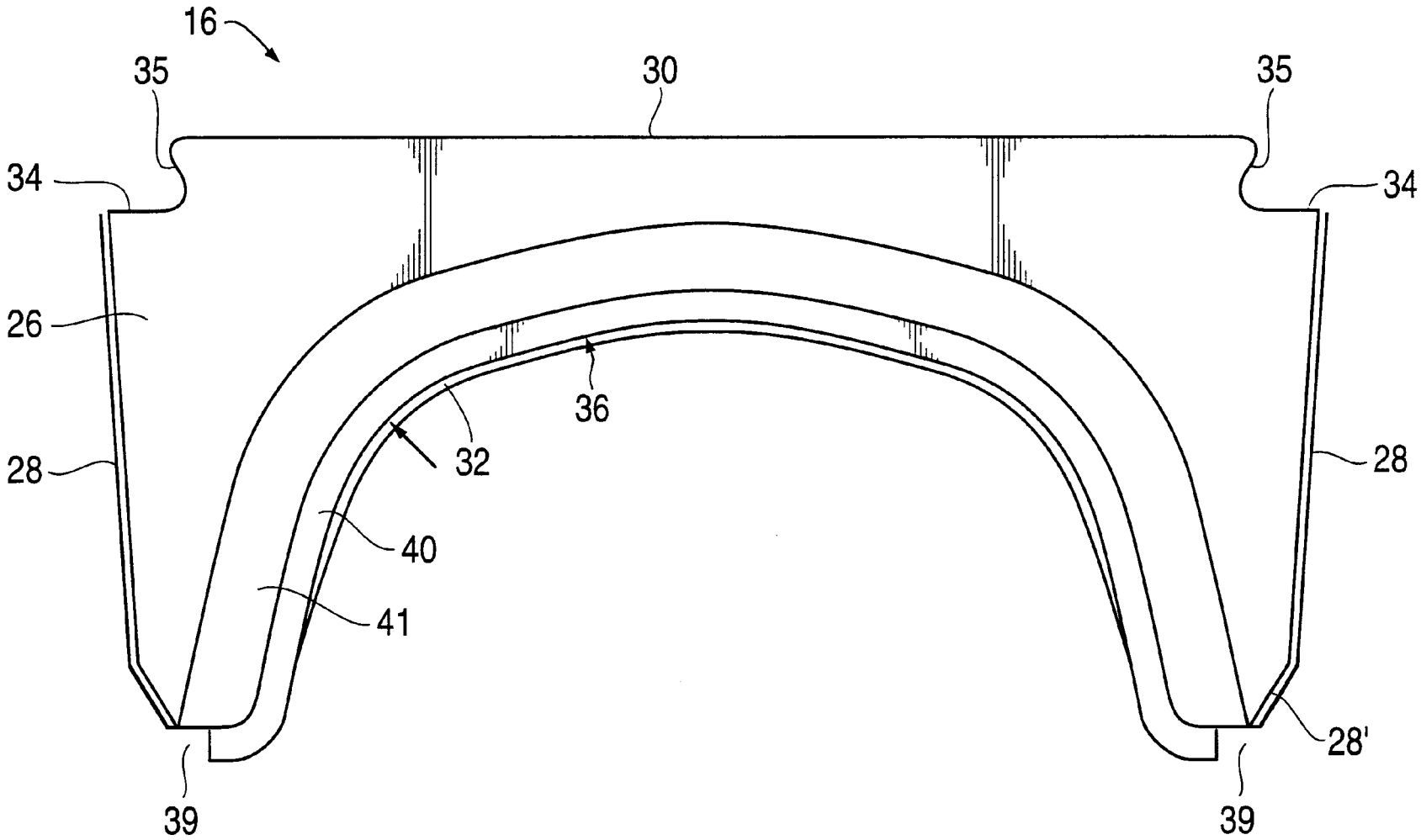
FIG. 4 is an enlarged rear elevation of one of the coffer units of FIG. 2.

As can be seen in FIGS. 3 and 4, the arcuate lips 36 projecting rearwardly from the coffer units 16 engage the front surfaces 24 on adjacent coffer units 16. Unlike projections in prior systems, the lips 36 do not require grinding because, although the lips contain imperfections which concentrate stresses, the compressive forces being transmitted through the lips 36 are purposely kept low by the assistance of shoring until the joints have been filled with grout and the grout has been cured to achieve sufficient strength to distribute and transmit compression forces between the adjacent coffer units 16 across the gaps. The lips 36 are present to provide a surface to support the grout in the interstices 44 between adjacent coffer units 16. It is possible that a little of the grout 46 will drop through small spaces between the lips 36 and the adjacent front surfaces 24 before the grout hardens but not enough to present a problem in practical terms. The compression forces between adjacent coffer units 16 are distributed and transmitted by the grout. As a result, no stress concentrations can occur in the coffer units 16.

As can be appreciated from FIG. 4, one of the features of the coffer units 16 is increased void area above the clip reception shoulders 34 to receive reinforcing bars at the top. This is useful in cantilever applications. In cantilever and other applications, the tops of the coffer units 16 may be in tension rather than in compression.

As can be seen from FIGS. 1 and 2, whether they are monolithic or composites of the moldable blocks 20, the joists 12 are U-shaped in cross-section defining a cambered trough to receive the longitudinal tension reinforcement and a fill of grout 22, which are anchored in the trough. The clip ties 14, which are anchored in the trough, become an integral part of the joists 12 upon the hardening of the bonding substance 22.

Figure 5:
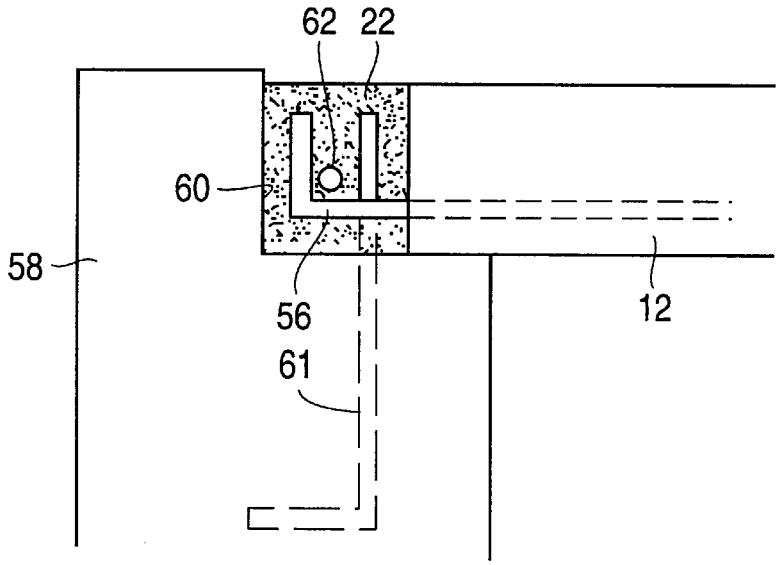
FIG. 5 is a schematic view of a connection of an end of a joists of the floor of FIG. 2 with a supporting wall.

The joists 12 are formed on cambered supports or casting tables so that the joists are cambered before loading and will approximate a horizontal line when their own weight (deadload) and the external load on them (live loads) are taken into consideration. Steel reinforcing bars 56 extend the length of the joists 12, at the bottom of the troughs, in the bonding substance 22. The reinforcing bars 56 enable the joists 12 to withstand the tension forces experienced by the lower portion of the floor 10 due to its beam action. The reinforcing bars may also be prestressed in the molding of the joists. The reinforcing bars 56 project from the ends of the joists, where they can be hooked at the factory to facilitate connection to a support 58, such as a supporting wall, as indicated in FIG. 5. In that figure, the support 58 includes a notch 60 to receive the end of the joist 12 and a reinforcing bar 61 secured in the support and projecting vertically above the bottom surface of the notch. Discrete vertical reinforcing bars 61 are commonly installed in supporting walls to anchor the floor or roof diaphragm. Another reinforcing bar 62 is secured in the support 58, extending through the notch 60 transversely to the reinforcing bars 61 of the supports 58 and the joists 12, completing the connection. The joist reinforcing bars 56 are anchored to the reinforcing bar 62 through the action of the hook and the embedment of the assembly in the grout fill 22 so as to transmit tension forces from the joist reinforcing bars 56 to the support reinforcing bars 61. Furthermore, with this arrangement, it is not necessary for the reinforcing bar 56 of the joist 12 to be in close alignment with the reinforcing bar 61 of the support 58 in a vertical plane parallel to the length of the joists. The portion of the notch 60 remaining empty after the connections between the reinforcing bars are made are filled with the grout 22. A plurality of the notches 60 can be formed in a supporting wall or can be continuous as a recess. Alternatively, the notches can be formed in discrete piers.

Figure 7:
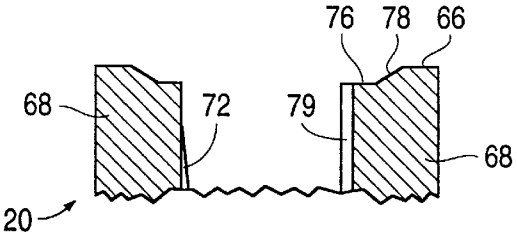
FIG. 7 is a fragmentary cross section taken along the line 7—7 in FIG. 6.
Figure 6:
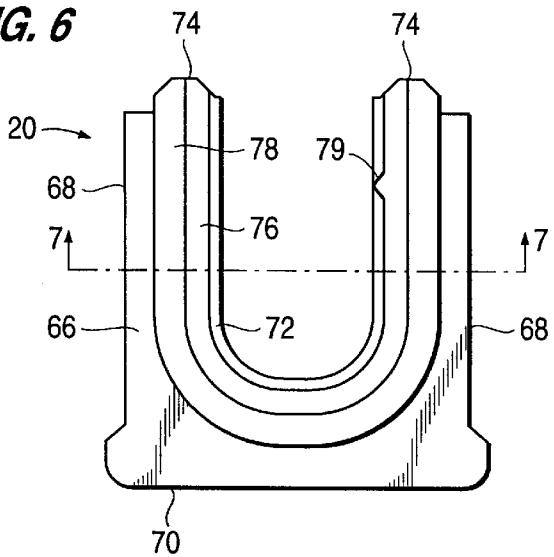
FIG. 6 is an enlarged rear elevation of one of the joist blocks of the floor of FIG. 2.

The monolithic joists can be extruded in lengths of as much as 50 feet or more. The U-shaped blocks 20 of the alternate form of the joist 12 are moldable in standard concrete block machines. As can best be seen from FIGS. 2, 6 and 8, each U-block 20 has a flat vertical front surface 64, a vertical rear surface 66, opposite side surfaces 68, a planar lower surface 70, a U-shaped inner surface 72 defining the trough, and a pair of elongate upper surfaces 74 extending from the front surface to the rear surface. At the rear end of the trough is a U-shaped surface 76 which is perpendicular to and contiguous with the inner surface 72. As can be understood from FIGS. 6 and 7, external to and contiguous with the recessed U-shaped surface 76 is a U-shaped beveled surface 78, which connects the recessed U-shaped surface 76 with the rear surface 66 such that the U-shaped beveled surface 78 and the recessed U-shaped surface 76 form a U-shaped recess at the rear of the block 20. A series of the blocks 20 are arranged placed with the rear surface 66 of each block in engagement with the front surface 64 of the adjacent block so that the interior surfaces 72 together define an elongate trough.

Figure 8:
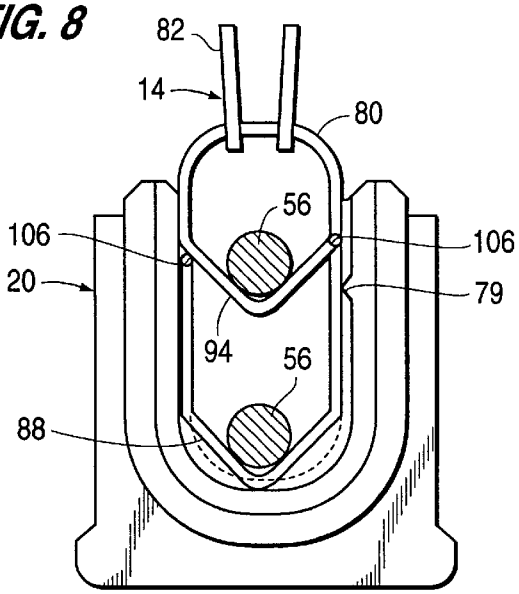
FIG. 8 is an enlarged rear elevation similar to FIG. 6 with a clip tie installed.

An integral dimple 79 is formed on one side of the inner surface 72, between one of the upper surfaces 74 of the 'U' block and the bottom of the trough, the dimple 79 protruding inwardly toward the center of the trough and extending longitudinally along the trough. The dimple 79 serves to key the grout 22 to the U-shaped block 20, so that the grout and the block act as a unit. The reinforcing bars 56 are positioned in the trough, utilizing the clip ties 14 as seats to locate the reinforcing bars correctly, as shown in FIG. 8, and the trough is filled with the grout 22. The cementitious grout 22 also fills U-shaped pockets defined by the U-shaped surface 76 and the U-shaped bevel surfaces 78 at the interfaces between adjacent blocks 20, as well as spaces resulting from an imprecise fit at the interfaces between adjacent blocks 20. When the grout 22 cures in these pockets and spaces, it is capable of transmitting compression forces between adjacent blocks 20, thereby preventing stress concentrations in areas which might project from the front and/or rear surfaces of the blocks 20 as a result of the imprecision inherent in molding concrete. The appropriate number of blocks 20 are used to form joists 12 of desired lengths. The U-shaped recesses defined by the surfaces 76 and 78 enable grout to penetrate between adjacent members of the joists in a manner similar to that of the lips 36 of the coffer units 16. Depending on their length, the joists 12 can be handled by several people or with a small hoist, the joists weighing approximately 18 pounds per linear foot. The joists can just be forms.

Figure 11:
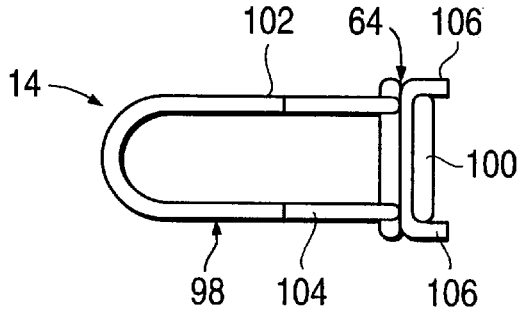
FIG. 11 is a top view of the clip tie of FIG. 10.
Figure 9:
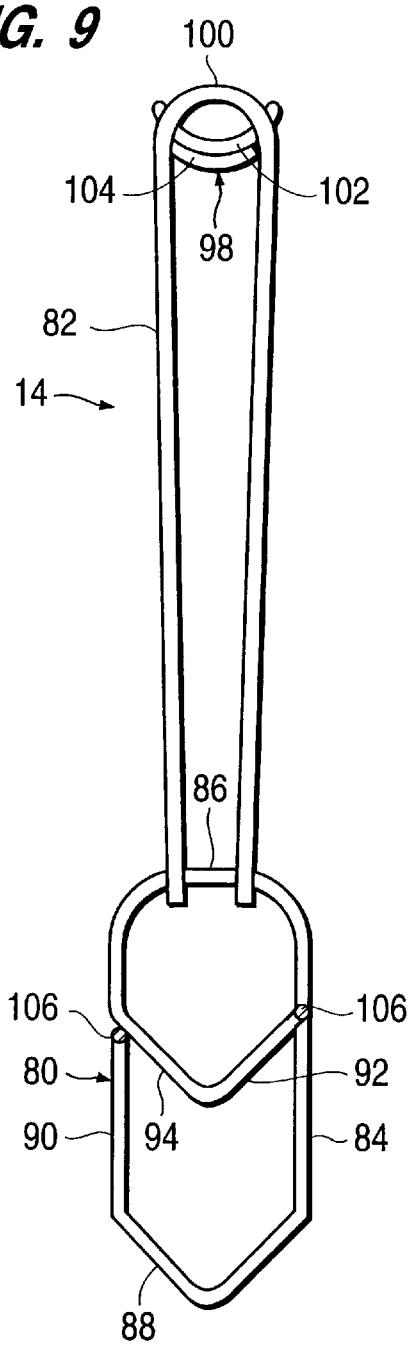
FIG. 9 is an enlarged front elevation of one of the clip ties in the floor of FIG. 2.
Figure 10:
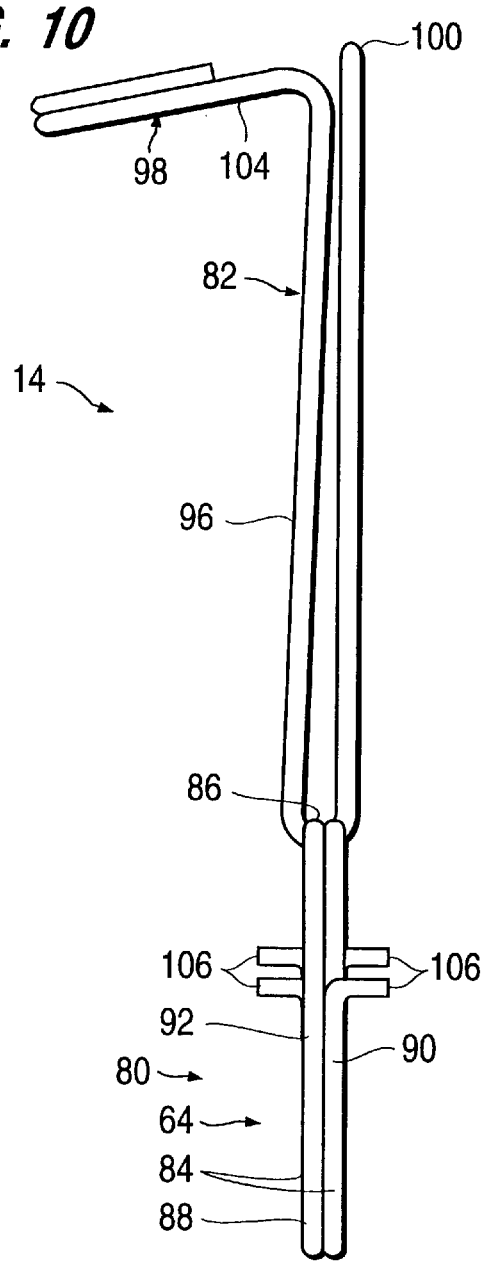
FIG. 10 is a right side view of the clip tie of FIG. 9.

The clip ties 14 provide a composite action between tensile (joist) and compressive (coffer) elements of the system as they clip and interlock the coffer units 16 to the joists 12. As can best be seen from FIGS. 9–11, each clip tie 14 includes a lower portion 80 and an upper portion 82 pivotally connected to the lower portion. Both portions are made of a high tensile strength material, such as steel wire. The lower portion 80 comprises one or more members 84, each defining a double loop of the high tensile strength material to receive and locate the tension reinforcement, each member 84 having a top 86, a bottom 88, and two sides 90, 92. In addition, the member 84 includes a transverse portion 94 extending from one side 90 to the other side 92 between the top 88 and the bottom 88 of the member. As can be seen from FIG. 9, the transverse portion 94 can comprise an extension of one end of the high tensile strength element forming the member 84, which end is turned toward the opposite side 92 of the member 84. The transverse portion 94 and the bottom 88 of the member 84 are shaped to have a low point midway between the sides of the member 84, such as a chevron shape in which the sides of the chevron define 45° angles with the sides 90 and 92 of the member. The bottom 88 of the member 84 and the transverse portion 94 support the reinforcing bars 56 of the joists 12 in spaced, parallel relationship. The shapes of the bottom 88 and the transverse portion 94 serve to center the joist reinforcing bars 56 midway between the sides 90 and 92 of the members 84.

As can be seen in FIG. 8, the members 84 are embedded in the joists 12 centrally with respect to the sides of the joist, the members 84 extending transversely across the trough, with the sides 90 and 92 in frictional engagement with the U-shaped inner surface 72 defining the trough, so that the members 84 are firmly retained in their positions. The shapes of the bottom 88 and the transverse portion 94 center the joist reinforcing bars 56 at the center of the joist 12. The members 84 can be formed of the same gauge steel wire as the upper portion 82, in which case, two lower members 84 may be used to equal the area of steel in the upper portion, so long as enough steel area is provided to counteract the large shear forces exerted lengthwise in the joist 12, between the lower and upper portions, or in the coffer units 16. A single lower member 84 of steel wire having a greater thickness could be used as well.

The upper portion 82 of the clip tie 14 comprises a member of high tensile strength material which defines elongate stirrups 96 for receiving the members 84 of the lower portion 84 in a pivot connection. At the top of the upper portion 82, remote from the lower portion 80 of the clip tie 14, a clip portion 98 projects transverse to a plane defined by the lower members 84. The clip portion 98 is also angled, from an end adjacent to the stirrup 96 to an end distal to the stirrup, toward the lower portion 80 of the clip tie 14. The clip portion 98 is resilient, so that it is deflected when the clip tie 14 engages a coffer 16 and ties the coffer to the joist 12. The resilience maintains the clip tie 14 in firm engagement with the coffer 16 and prevents the clip tie from slipping off of the coffer. In the embodiment illustrated, the upper portion 82 of the clip tie 14 is made of steel wire which is resilient in itself, in addition to having high tensile strength. The clip portion 98 is formed integrally with a side of each stirrup 96 at an angle of slightly less than 90°, and the resilience of the material of the clip portion biases the clip portion toward maintaining this angle. The entire upper portion 82 can be formed of a single piece of steel wire so as to provide both sides of the stirrups 96, the clip portion 98 and an inverted U-shaped portion 100 connecting the two stirrups. The clip portion 98 can also be U-shaped, having sides 101, 102, 104 defined by extensions projecting from sides of the stirrup 96 at their tops, each side being bent toward the other side to define overlapping portions forming an arcuate end to the clip portion and extending partly along the opposite side.

The lower portions 80 of the clip ties 14 are made integral with the joists 12 by the fixing of the lower portions in the troughs defined in the joists 12, as can be appreciated from FIGS. 2 and 8. Although the clip ties 14 are illustrated only in connection with the joists 12 defined by a plurality of the blocks 20, it is understood that the clip ties are similarly fixed in the joists 12 defined by a single elongate U-shaped member. The ends of members 84 of the bottom portions 80 of the clip ties 14 are bent to extend transversely to the plane defined by the members 84, and the bent portions 106 extend generally parallel to and engage the internal sides of the joists 12 defining the troughs, some of the bent portions 106 engaging the underside of the dimple 79 and some of the bent portions 106 engaging the upper side of the dimple 79. The bottoms 88 and the transverse portions 94 of the members 80, which center the joist reinforcing bars 56, also space the bars from one another.

The upper portions 82 of the clip ties 14 pivot with respect to the lower portions 80. Thus, the upper portions 82 can be pivoted upward when the coffer units 16 are placed on the joists 12 in which the clip ties 14 are secured. The clip portion 98 of the upper portion 82 extends over and onto the shoulders 34 of the coffer units 16, and grout is poured into the interstices 42 and 44 between the coffer units, thereby totally enveloping the clip ties 14 and tying the compression region of the top of the floor 10 to the bottom region of the floor through which the joist reinforcing bars 56 extend and which is in tension. Because there is compression in the upper region of the floor 10 and tension in the bottom region, shear forces tend to cause the floor to shear along planes between the compression and tension regions. Therefore, the clip ties 14 are used to cross the regions undergoing shear forces in order to resist the shear forces.

The clip ties 14 are anchored in the joists 12 at the factory. The locations of the clip ties 14, along with their configuration, assures that the clip ties are engaged with the coffer units 16 to integrate the coffer units with the joists 12, so that loads are supported by the composite action of the coffer units and joists. The upper portion 82 of each clip tie 14 pivots between a generally horizontal position, in which it extends along the top of the joist 12, to a vertical position, in which it engages the shoulders 34 of two of the coffer units 16. A coffer unit 16 cannot be placed in its position on and between adjacent joists 12 if the clip ties 14 associated with the previous coffer unit 16 are not engaged with the shoulders 34 of the previous coffer unit but instead remain horizontal along the tops of the joists. The presence of a clip tie 14 in any position other than the position engaging the shoulder 34 of the previous coffer unit 16 obstructs the normal placement of additional coffer units on the joists 12. The site of an additional coffer unit 16 is unobstructed only when the upper portions 82 of clip ties 14 associated with the previous coffer unit are pivoted up to the vertical position engaging the shoulders 34 of the previous coffer unit. Thus, the system according to the present invention avoids the need for careful inspection to assure that the coffer units 16 are integrated with the joists 12 by means of the clip ties 14.

The tying of the compression region to the tension region results in a composite action. The lower portions of the spring clips are sufficiently firmly retained in the channel members that they will not move out of position when reinforcing bars are slid through them. It is contemplated that the joists will most likely be completely assembled and grouted at the factory. This helps assure that workers in the field will not omit clips when assembling structures using the present invention. The ties also serve as handles.

The coffer units in the floor system according to the present invention are laid dry by means of the interlock recesses in the joists, with which they cooperate. Furthermore, as they are laid, even before the floor is complete, the coffer units define a surface which is capable of supporting loads, such as workers and materials, thereby avoiding the need for additional scaffolding. The joists can be made as long as necessary in a U-shaped cross-section.

The coffer units 16 act structurally, meaning that their weight is compensated by their beam function in compression. There is no need for grinding or other expensive, skilled or labor-intensive procedures. After the coffer units 16 are put in place, recesses around the coffer units are grouted flush with the top surfaces of the coffer units for a completed floor or roof surface that can be carpeted, tiled or covered with roofing materials, as the case may be. The joint interstices around the coffer units 16 are filled with grout, which in turn is vibrated with either a pencil-type or plate-type vibrator.

In combination, the joists 12 and the coffer units 16 form a horizontal diaphragm which can be used as a floor or a roof, with its underside becoming a ceiling. The joists 12, which may be parallelograms or trapezoids, are placed parallel to one another, separated from one another by a distance slightly less than the length of the coffer units 16. The coffer units 16 are placed on the joists 12 such that the lateral edges of the coffer units fit into the shoulders 34 of the joists. Thus, the coffer units 16 form their own supporting surface as they are laid. The weight of the coffer units 16 on the joists 12 tends to straighten out the camber in the joists and places the coffer units along the joists in mild compression against one another. Two coffer units 16 which are placed laterally with respect to each other are secured to the joists 12 by swinging the upper portions 82 of the clip ties 14 of the joists up to engage the shoulders 34 on the coffer units. The clip ties 14 lock the coffer units 16 to the joists 12 so that the coffer units cooperate with the joists in composite action to resist the horizontal forces resulting from bearing the vertical loads imposed on the floor 10. The coffer units 16 act generally in compression, while the joists act generally in tension.

Figure 12:
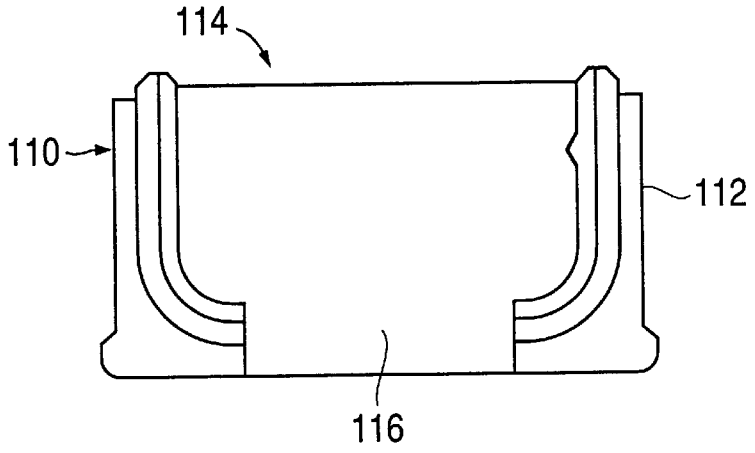
FIG. 12 is an end view of a tapered joist made with half 'U' blocks according to the present invention.
Figure 13:
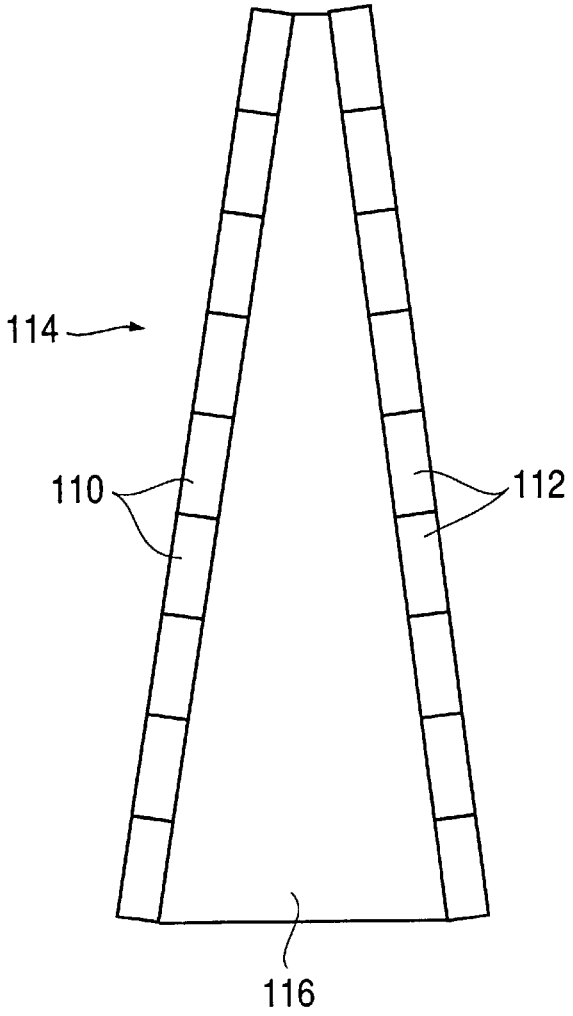
FIG. 13 is a schematic top plan view of the tapered joist of FIG. 12.

As can be seen from FIGS. 12 and 13, the joists 12 can be formed from molded blocks 110 and 112, each of which defines the shape of one half of a U-shaped block 20, a half defined by bisecting one of the blocks 20 at the bottom of the 'U'. The half 'U' blocks 110, 112 have the same structure as one-half of a U-shaped block 20 in all respects. The half 'U' blocks 110 can be placed in engagement with opposing half 'U' blocks 112 to construct a joist very much like the joists formed through the use of the U-shaped blocks 20. However, the half 'U' blocks can also be used to form tapering or flaring joists, such as the joists 114 illustrated in FIGS. 12 and 13. In order to form such a flaring or tapering joist 114, a plurality of half 'U' blocks 110, all of which define the same side of the 'U' as one another are placed on a forming table along a line in front-to-rear engagement with one another. Similarly, a plurality of half 'U' blocks 112 defining the other side of the 'U' are positioned in front-to-rear engagement with one another along a line diverging at an angle from the first line. The facing rows of half 'U' blocks 110, 112 define a trough between them, and form walls (not shown) are placed at the front and rear of the trough. Clip ties 14 and reinforcing bars 56 are positioned at appropriate locations, and the trough is filled with concrete 116 and allowed to dry, thereby forming the flaring or tapering joist 114. The form walls are removed before the joist is shipped. It can be appreciated that use of such a flaring or tapering joist 114 allows adjacent sections of floor according to the present invention to be oriented at an angle to one another. As a result, the system according to the present invention has the ability to provide floor sections which can be trapezoids, as well as floor sections which are simple parallelograms.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

I claim:

1. A construction unit for constructing suspended horizontal diaphragms for the generation of floor and roof structures comprising:

a generally planar upper surface;

a front surface extending transverse to said upper surface;

a rear surface extending transverse to said upper surface;

two opposite side surfaces;

a lower surface; and a lip projecting from said rear surface along a line below said upper surface and extending substantially from one of said side surfaces to the other of said side surfaces, wherein, from said front surface to said rear surface, said side surfaces and said lower surface taper toward an axis of said construction unit which is perpendicular to said front and rear surfaces.

2. The construction unit of claim 1, wherein said lower surface defines a channel extending between said front surface and said rear surface.

3. The construction unit of claim 2, wherein said lower surface has a lowest portion, said channel having a maximum height above said lowest portion, said maximum height being equal to at least half of the distance between said lowest portion and said upper surface of the construction unit.

4. The construction unit of claim 1, further comprising a recessed shoulder at the top of each of said side surfaces, each said shoulder having a first surface below and substantially parallel to said upper surface of said construction unit.

5. The construction unit of claim 4, wherein each said shoulder has a second surface extending from said first surface to said upper surface of said construction unit, and said shoulders extend from said front surface of said construction unit to said rear surface.

6. A generally horizontal building diaphragm assembled out of discrete units comprising:

at least two parallel joists acting primarily in tension;

a plurality of construction units acting primarily in compression, each having a top surface, a front surface, a rear surface and opposite side surfaces, each construction unit extending from one of said joists to the other of said joists and resting and interlocked on both of said joists, said opposite side surfaces of each said construction unit being in vertical alignment with said joists, each said construction unit further having a lip projecting from said rear surface along a line below said upper surface and extending from one of said side surfaces to the other of said side surfaces, said lips engaging the front surfaces of adjacent ones of said construction units; and means for structurally tying said construction units to said joists.

7. The building diaphragm of claim 6, wherein interstices are defined between adjacent construction units above said lips, the concrete diaphragm further comprising grout filling said interstices.

8. The building diaphragm of claim 6, wherein said means for structurally tying said construction units to said joists comprises clip ties anchored in said joists.

9. The building diaphragm of claim 8, wherein each said clip tie has a lower portion anchored in one of said joists and an upper portion pivotally connected to said lower portion, said upper portion being movable from a first position to a second position extending over and bearing down on at least one of said construction units.

10. The building diaphragm of claim 9, wherein, in its second position, said upper portion extends over and bears down on two of said construction units.

11. The building diaphragm of claim 9, wherein each construction unit further has a shoulder at the top of each of said side surfaces, each said shoulder having a surface below and substantially parallel to said upper surface of said construction unit, and said upper portions of said clip ties, in their second positions, extend over and bear down on said shoulders.

12. The building diaphragm of claim 11, wherein said upper portions of said clip ties, in their second positions, terminate below said top surfaces of said construction units, and grout fills the volumes below said surfaces of said shoulders and said upper surfaces of said construction units.

13. The building diaphragm of claim 11, further comprising a reinforcing bar positioned on and extending along at least one of said shoulders of each said construction unit.

14. The building diaphragm of claim 9, wherein a plurality of said clip ties are anchored in each of said joists, said clip ties being spaced along the joists by a distance to define a site for one of said construction units.

15. The building diaphragm of claim 14, wherein said upper portions of said clip ties obstruct construction unit sites when said upper portions are in positions other than said second position.

16. The building diaphragm of claim 6, wherein each said construction unit has a lower surface defining a channel, the assembly of construction units having elongate channels extending parallel to said joists, each said elongate channel being defined by a plurality of said lower surfaces.

17. The building diaphragm of claim 6, wherein each joist comprises:

an elongate member having a length and a continuous camber along its length, said elongate member defining a trough;

a bonding substance filling said trough; and at least one reinforcing element extending along the length of the elongate member, near the bottom of the trough, said reinforcing member being under tension.

18. The building diaphragm of claim 17, wherein the elongate member of each joist is monolithic.

19. The building diaphragm claim 17, wherein the elongate member of each joist comprises a plurality of U-shaped blocks.

20. In combination, a concrete element;

a supporting structure including a bonding substance; and a clip tie device for structurally connecting the concrete element to the supporting structure, wherein the clip tie device has a lower portion anchored in the bonding substance of the supporting structure, and an upper portion pivotally connected to said lower portion, said upper portion being external to said supporting structure and having a first end adjacent to said lower portion, a second end distal to said lower portion, and a resilient clip portion projecting at an angle from said second end, the clip portion engaging the concrete element.

21. A joist comprising:

an elongate member having a length and a continuous camber along its length, said elongate member defining a trough;

a bonding substance filling said trough; and at least one reinforcing element extending along the length of the elongate member, near the bottom of the trough, said reinforcing member being under tension.

22. The joist of claim 21, wherein said reinforcing element projects from the ends of the elongate member, portions of said reinforcing element projecting from the ends of the elongate member defining hooks for cooperating with reinforcing elements in structures supporting the ends of the elongate member.

23. The joist of claim 22, wherein the hooks extend upwardly.

24. The joist of claim 21, wherein the elongate member is monolithic.

25. The joist of claim 21, wherein the elongate member comprises a plurality of U-shaped blocks.

26. The joist of claim 21, further comprising means for tying construction units to the joist.

27. The joist of claim 21, further comprising clip ties anchored in said bonding substance in order to tie construction units to the joist.

28. The joist of claim 27, wherein each clip tie comprises a lower portion anchored in the bonding substance and an upper portion pivotally connected to said lower portion.

29. A construction unit for constructing suspended horizontal diaphragms for the generation of floor and roof structures comprising:

a generally planar upper surface;

a front surface extending transverse to said upper surface;

a rear surface extending transverse to said upper surface;

two opposite side surfaces;

a lower surface;

a lip projecting from said rear surface along a line below said upper surface and extending substantially from one of said side surfaces to the other of said side surfaces; and a recessed shoulder at the top of each of said side surfaces, each said shoulder having a first surface below and substantially parallel to said upper surface of said construction unit, wherein each said shoulder has a second surface extending from said first surface to said upper surface of said construction unit, and said shoulders extend from said front surface of said construction unit to said rear surface.

30. A construction unit for constructing suspended horizontal diaphragms for the generation of floor and roof structures comprising:

a generally planar upper surface;

a front surface extending transverse to said upper surface;

a rear surface extending transverse to said upper surface;

two opposite side surfaces;

a lower surface; and a lip projecting from said rear surface along a line below said upper surface and extending substantially from one of said side surfaces to the other of said side surfaces, wherein said lower surface defines a channel extending between said front surface and said rear said surface, said channel having open opposite ends.

31. The construction unit of claim 30, wherein said channel is spaced from said opposite side surfaces of the construction unit.

32. The construction unit of claim 31, wherein said channel is midway between said opposite side surfaces.

33. The construction unit of claim 30, wherein said lower surface has a lowest portion, said channel having a maximum height above said lowest portion, said maximum height being equal to at least half of the distance between said lowest portion and said upper surface of the construction unit.

34. A construction unit for constructing suspended horizontal diaphragms for the generation of floor and roof structures comprising:

a generally planar upper surface;

a front surface extending transverse to said upper surface;

a rear surface extending transverse to said upper surface;

two opposite side surfaces;

a lower surface; and a lip projecting from said rear surface along a line below said upper surface and extending substantially from one of said side surfaces to the other of said side surfaces, wherein an interlocking channel is defined between the lower surface and each of the opposite sides surfaces, each of the interlocking channels being adapted to receive an edge of a joist.

35. A generally horizontal building diaphragm assembled out of discrete units comprising:

at least two parallel joists acting primarily in tension and defining a tension bearing portion of the diaphragm;

a plurality of construction units acting in compression and defining a compression bearing portion of the diaphragm, each construction unit having a top surface, a front surface, a rear surface and opposite side surfaces, each construction unit extending from one of said joists to the other of said joists and resting and interlocked on both of said joists, said opposite side surfaces of each said construction unit being in vertical alignment with said joists; and tie members structurally tying said tension bearing portion to said compression bearing portion to act as a composite tension bearing and compression bearing unit.

36. The building diaphragm of claim 35, wherein said joists are cambered along their length, whereby loads on said joists tend to straighten said joists into horizontal lines and place the construction units into firm contact with one another.

37. The building diaphragm of claim 35, wherein the front surface and the rear surface of each construction unit faces the rear surface and the front surface, respectively, of adjacent construction units of the plurality, grout is interposed between the facing front and rear surfaces, and the construction units and the grout are in compression.

* * * * *